United States Patent [19]

Pryor et al.

[11] 3,940,290

[45] Feb. 24, 1976

[54] PROCESS FOR PREPARING COPPER BASE ALLOYS

[75] Inventors: Michael J. Pryor; Jacob Crane, both of Woodbridge; Sam Friedman; Eugene Shapiro, both of Hamden, all of Conn.

[73] Assignee: Olin Corporation, New Haven, Conn.

[22] Filed: July 11, 1974

[21] Appl. No.: 487,470

[52] U.S. Cl. ..... 148/2; 75/154; 148/11.5 R; 148/12.7; 148/32.5; 148/160

[51] Int. Cl.[2] ..... C22F 1/08; C22C 9/06

[58] Field of Search..... 148/2, 11.5 R, 12.7, 160, 148/32.5; 75/153, 154, 159

[56] References Cited

UNITED STATES PATENTS

| | | | |
|---|---|---|---|
| 1,535,542 | 4/1925 | Price | 75/159 |
| 1,928,747 | 10/1933 | Wise | 75/159 X |
| 2,117,106 | 5/1938 | Silliman | 75/159 X |
| 2,210,670 | 8/1940 | Kelly | 75/154 |
| 2,269,581 | 1/1942 | Crampton et al. | 75/154 |
| 3,698,965 | 10/1972 | Ence | 148/11.5 R |

OTHER PUBLICATIONS

Alloy Digest, CDA Alloy 725, Cu–229, Mar. 1971.

*Primary Examiner*—C. Lovell

*Attorney, Agent, or Firm*—Robert H. Bachman; David A. Jackson

[57] ABSTRACT

Improved properties are obtained in copper alloys containing from 7 to 14% nickel, from 1.5 to 3.3% tin, plus iron and/or cobalt in an amount from 0.1 to 3% each, by hot rolling, cold rolling, annealing and cold rolling, all under defined conditions. The resultant alloys are characterized by good strength, good bend properties, good solderability and low contact resistance.

10 Claims, No Drawings

PROCESS FOR PREPARING COPPER BASE ALLOYS

BACKGROUND OF THE INVENTION

It is highly desirable to provide copper base alloys having good strength properties as well as good bend properties, good solderability and low contact resistance. It is particularly desirable to provide copper alloys having these properties and which are convenient to process plus may be made economically on a commercial scale.

Commercially, copper alloys tend to be deficient in one or more of the foregoing characteristics. For example, the commercial copper Alloy 510 (a phosphor-bronze containing from 3.5 to 5.8% tin and from 0.03 to 0.35% phosphorus) is superior in strength but poor in bend characteristics. The commercial copper Alloy 725 (a copper-nickel containing 8.5 to 10.5% nickel and 1.8 to 2.8% tin) is superior with respect to bend properties, solderability and contact resistance but deficient in strength.

Accordingly, it is a principal object of the present invention to provide a process for obtaining an improved copper alloy having a combination of good strength properties, good bend properties, good solderability and desirably low contact resistance.

It is a further object of the present invention to provide a process as aforesaid which may be readily utilized commercially and which is characterized by relatively low cost.

Further objects and advantages of the present invention will appear hereinbelow.

SUMMARY OF THE INVENTION

In accordance with the present invention it has been found that the foregoing objects and advantages may be readily obtained. The copper base alloys processed in accordance with the present invention contain nickel from 7 to 14%, tin from 1.5 to 3.3%, a material selected from the group consisting of iron from 0.1 to 3%, cobalt from 0.1 to 3%, and mixtures thereof, wherein the minimum iron plus cobalt content must be 1.0%, and the balance essentially copper. The foregoing alloys are processed by: hot rolling with a finishing temperature in excess of 550°C; cold rolling with a reduction of at least 20%; annealing at a temperature of from 300° to 850°C for at least 1 minute; and cold rolling with a reduction of at least 20%.

The microstructure of the wrought alloy produced in accordance with the process of the present invention is characterized by the presence of a fine dispersed magnetic phase containing said material selected from the group consisting of iron, cobalt and mixtures thereof.

The process of the present invention may be conveniently utilized on a commercial scale and is characterized by a relatively moderate cost. In addition, and surprisingly, it has been found that the resultant alloy has an improved combination of strength and bend properties plus good shelf life solderability and low contact resistance.

DETAILED DESCRIPTION

As indicated hereinabove, the copper base alloy processed in accordance with the present invention contains from 7 to 14% nickel and from 1.5 to 3.3% tin. It is preferred that the minimum nickel plus tin content be 9.5% and it is also preferred that the nickel content be in the range of 9 to 11% and the tin content be in the range of 2 to 3%, with the minimum nickel plus tin content optimally being 11.5%. The minimum nickel plus tin content is employed in order to obtain good strength characteristics.

The copper base alloy contains either iron or cobalt or both iron and cobalt, each in an amount from 0.1 to 3% and preferably from 0.5 to 3% each, with a minimum iron plus cobalt content being 1% and preferably 1.5%. The minimum iron plus cobalt content aids in grain refinement, the resultant alloys of the present invention having a fine grain size below 0.025 mm. A fine grain size provides good strength characteristics at a given cold reduction. In addition, the minimum iron plus cobalt content is necessary for the precipitation of sufficient magnetic phase to obtain desirable properties. Below the aforesaid minimum iron plus cobalt limits, one obtains insufficient magnetic phase to obtain desirable properties in the resultant alloys of the present invention, as strengthening.

The balance of the alloy of the present invention is essentially copper. Naturally, conventional impurities are contemplated and additives may be incorporated in order to accentuate a particular property. Generally normal brass mill impurities may be tolerated in the alloys, but should preferably be kept at a minimum. For example, phosphorus should preferably be maintained below 0.1%, lead below 0.05% and sulfur below 0.05% to preclude the possibility of interference with hot processing. Typical additives which may be included are manganese up to 0.5%, magnesium up to 0.1%, and small amounts of calcium, chromium, zirconium, titanium and misch metal.

The higher ranges of iron plus cobalt, particularly in excess of 3% of each of these materials, may impair ductility and hot workability. Accordingly, one should restrict the upper limit of iron and/or cobalt to 3% in order to minimize this problem.

A particularly significant feature of the alloy prepared in accordance with the process of the present invention is the presence of a fine dispersed phase which is magnetic and which contains iron and/or cobalt. It is believed that the presence of this magnetic phase significantly contributes to the excellent properties of the alloy of the present invention. The magnetic phase is submicroscopic and not optically observable at a magnification of 1000X. Clearly the magnetic phase is not an aggregate phase as it would then be optically resolvable; therefore, the magnetic phase must be a dispersed phase. The resultant alloys exhibit increased magnetic attraction with aging. Hence, one must obtain precipitation of magnetic particles upon aging. It is significant that no magnetic effect is obtained in the same composition without the iron and/or cobalt addition.

The alloys may be cast in any desired manner, for example, Durville or DC casting. A sufficient melting temperature is required in order to insure that all components are in solution and uniformly mixed. It is preferred that the minimum melting temperature be at least 1250°C and preferably at least 1275°C. The minimum casting temperature should be at least 1150°C to avoid segregation and promote homogeneity. Inadequate casting temperature may promote the formation of undesirable coarse particles of iron and cobalt which may interfere with ductility, reduce the available amounts of iron and/or cobalt for the subsequent formation of the magnetic phase, and may represent sites for finishing defects and premature failure. Rapid cooling rate during casting is also desirable, particularly in the range of from about 1150° to 1090°C.

After casting, the alloy is hot rolled in order to break up the cast structure. The amount of hot rolling reduction is not critical and the starting hot rolling temperature is not critical provided that incipient melting does not occur. Generally, starting hot rolling temperatures of from 850°–975°C are sufficient to insure the absence of incipient melting. One should hot roll the alloy so that one does not finish hot rolling below about 550°C since finishing hot rolling below 500°C promotes excessive production of a second phase of nickel and tin which tends to impair ductility.

Following hot rolling the alloy may be cold rolled and annealed. In addition, if desired, the alloy may be annealed immediately after hot rolling at a temperature of 400° to 700°C for at least 1 minute. If the cold rolling and annealing sequence rolling such that one obtains complete recrystallization following the cold folling and annealing sequence, then one obtains the optimum combination of strength and bend properties upon subsequent cold rolling. If complete recrystallization is not obtained following the cold rolling and annealing sequence, the strength is greater, but is associated with relatively poorer bend properties in the final cold rolled product. The annealing temperature is from 300° to 850°C, preferably below 650°C if no recrystallization is desired, i.e., for maximum strength, and preferably from 600° to 850°C if recrystallization is desired, i.e., to obtain optimum combination of strength and bend properties in the final cold rolled product. The holding time at temperature is naturally dependent upon the temperature and desired properties. At least 1 minute at temperature is normally required. At least 20% cold reduction is required, and generally from 40–70% prior to annealing.

Following the annealing step, one provides an additional cold reduction of at least 20% and preferably from 20 to 50% preferably followed by an aging step of from 300° to 550°C and preferably from 300° to 500°C for from 15 minutes to 24 hours. An additional cold reduction may be employed, for example, from 20 to 55%. The cold reduction prior to aging creates nucleation sites for more effective distribution of the magnetic phase, the distribution of which is promoted by aging. In addition, the cold reduction creates nucleation sites for more effective distribution of other phases, as the aforementioned nickel-tin phase which should be distributed throughout the matrix.

If the maximum combination of strength and bend properties are desired, i.e., if the cold reduction — annealing cycle described above results in recr stallization of the alloy, the total cold reduction following the recrystallization annealing step should be less than about 65%. If, on the other hand, maximum strength properties are desired irrespective of bend properties, it is not necessary to limit the total reduction following the recrystallization annealing step.

It has been found that a process as described hereinabove, involving recrystallization in the cold reduction and annealing cycle and a total cold reduction following the annealing step of less than about 65%, results in improved properties in low stacking fault energy copper alloys generally, and also in copper alloys containing dispersed second phases.

The present invention and improvements resulting therefrom will be more readily apparent from a consideration of the following illustrative examples.

EXAMPLE I

A series of alloys were prepared having the composition set forth in Table I below.

TABLE I

| Alloy | % Ni | % Sn | % Fe | % Co | % Cu |
|---|---|---|---|---|---|
| A | 9.5 | 2.3 | 1 | | Bal. |
| B | 9.5 | 2.3 | 2 | | Bal. |
| C | 9.5 | 2.3 | 2.3 | | Bal. |
| D | 9.5 | 2.3 | 1 | 1 | Bal. |
| E | 9.5 | 2.3 | | 2 | Bal. |
| F | 9.5 | 2.3 | 3 | | Bal. |
| G | 8.5 | 1.8 | 2 | | Bal. |
| H | 10.5 | 2.8 | 2 | | Bal. |
| I | 9.5 | 2.3 | 1 | 0.4 | Bal. |

All alloys were Durville cast, and in addition Alloys B, D and E were DC cast. The melting temperature for the Durville and DC castings was about 1300°C, the casting temperature for the Durville castings was between 1200° and 1275°C, and the casting temperature for the DC castings was about 1200°C.

EXAMPLE II

Durville cast Alloys A, B, F, G and H were processed in the following manner. The alloys were hot rolled from a thickness of about 1¾ to about 0.4 inch thick at a starting temperature of 950°C and a finishing temperature of about 600°C. The alloys were surface milled to produce a clean surface followed by cold rolling to 0.080 inch gage and annealing at 675°C for 1 hour. The materials were then cold rolled 50% to 0.040 inch gage, aged at 400°C for 16 hours and cold rolled to 0.020 inch gage. The good strength properties are given in Table II, below.

TABLE II

| Alloy | Ultimate Tensile Strength, ksi | 0.2% Yield Strength, ksi |
|---|---|---|
| A | 117 | 113 |
| B | 122 | 118 |
| F | 122 | 117 |
| G | 112 | 109 |
| H | 128 | 122 |

EXAMPLE III

DC cast Alloys B and E were processed in a manner after Example II, except that they were hot rolled from 3 to about 0.4 inch and were chemically etched from 0.040 inch gage to 0.029 inch gage for convenience in providing equivalent final gage for bend comparisons, then aged at 400°C followed by cold rolling to 0.020 inch gage. As a comparison, samples of commercial Alloy 725 (containing about 9.5% nickel, about 2.3% tin, balance copper) and commercial Alloy 510 (containing about 4.5% tin, about 0.05% phosphorus, balance copper) were processed so that the resultant grain sizes were comparable, i.e., following hot rolling, cold roll to 0.080 inch, anneal at 600°C for 2 hours, and cold roll to final gage of 0.020 inch. The properties are shown in Table III, below. These data clearly show that the strength of the alloys of the present invention is significantly greater than that of Alloy 725, while the minimum bend radii are essentially equivalent, i.e., within 1/64 inch. Alloy 510 has somewhat lower strength than the alloys of the present invention, and the bad way minimum bend radius is significantly worse. The bent test compares the bend characteristics of samples bent over increasingly sharper radii until fracture is noted. The smallest radius at which no fracture is observed is called the minimum bend radius. When the bend axis is perpendicular to the rolling direction, it is called "good way bend", and parallel to the rolling direction is called the "bad way bend".

TABLE III

| Alloy | Ultimate Tensile Strength, ksi | 0.2% Yield Strength, ksi | Minimum Bend Radius, 64ths Good Way | Bad Way |
|---|---|---|---|---|
| B | 121 | 114 | 3 | 4 |
| E | 125 | 119 | 3 | 4 |
| Alloy 725 | 102 | 96 | 2 | 3 |
| Alloy 510 | 117 | 107 | 2 | 12 |

EXAMPLE IV

Alloys C and I were hot rolled from 1¾ to 0.4 inches with a starting temperature of about 950°C and a finish temperature of about 600°C. The alloys were cold rolled to 0.080 inch gage, annealed at 600°C for 2 hours and at 450°C for 1 hour, followed by cold rolling to 0.018 inch gage. The alloys were then tested for shelf life solderability. The shelf life solderability was determined as measured in a standardized dip test using four quality classifications. In this classification series, Class 1 indicates the best solderability and Class 4 the poorest. Two flux conditions were used, the 100 flux being a milder less aggressive flux than the 611 flux. The data are described in Table IVA below wherein each alloy was tested after a shelf time of zero hours, 2500 hours, and 5000 hours. It can be seen that in all cases the shelf life solderability after the process of the present invention remains good. For comparison purposes the comparable data for Alloy 725 are given.

In addition, the shelf life contact resistance of Alloys C and I and 725 were tested by determining the contact resistance of contact area between the sample surface and a spherically shaped contacter by measuring at various contact pressures between the two. Low values of contact resistance are desirable. The data are shown in Table IVB below after a shelf time of 3500 hours for Alloy C and shelf time of 6000 and 10,000 hours for Alloy I and a shelf time of 3500 and 10,000 hours for Alloy 725. It can be seen that desirably low values are obtained.

TABLE IVA

| Alloy | Shelf Time (hrs.) | Solderability Class 100 Flux | 611 Flux |
|---|---|---|---|
| C | 0 | 2 | 2 |
| C | 2500 | 3 | 2 |
| C | 5000 | 3 | 3 |
| I | 0 | 2 | 2 |
| I | 2500 | 3 | 3 |
| I | 5000 | 3 | 3 |
| 725 | 0 | 2 | 1 |
| 725 | 2500 | 3 | 3 |
| 725 | 5000 | 3 | 3 |

TABLE IVB

| Alloy | Shelf Time (hrs.) | Contact Resistance (OHMS) at Load (GMS) 20 | 50 | 100 | 200 | 1000 |
|---|---|---|---|---|---|---|

TABLE IVA-continued

| Alloy | Shelf Time (hrs.) | | Solderability Class 100 Flux | | 611 Flux | |
|---|---|---|---|---|---|---|
| C | 3500 | .11 | .089 | .074 | .059 | .025 |
| I | 6000 | — | .067 | .047 | .031 | .023 |
| I | 10,000 | .047 | .043 | .042 | — | .029 |
| 725 | 3500 | .13 | .056 | .085 | .068 | .022 |
| 725 | 10,000 | .053 | .049 | .038 | — | .029 |

The foregoing data show that solderability and contact resistance for the alloys of the present invention are comparable to that of Alloy 725.

EXAMPLE V

This example illustrates the effect of recrystallization before cold rolling and aging on bend and strength properties. Durville cast Alloy B from Example I was hot rolled and cleaned as in Example II and processed in accordance with Process A as follows: cold rolled to 0.080 inch gage; annealed at 600°C for 2 hours and 400°C for 1 hour; and cold rolled to a final gage of 0.020 inch. The last anneal did not fully recrystallize the alloy.

DC cast Alloy B from Example I was hot rolled and cleaned as in Example II and processed in accordance with Process B as follows: cold rolled to 0.080 inch gage; annealed at 675°C for 1 hour; cold rolled to 0.040 inch gage; aged at 400°C for 16 hours; and cold rolled to a final gage of 0.020 inch. The last anneal fully recrystallized the alloy. The strength and bend properties for both samples are shown in Table V, below.

TABLE V

| Process | Ultimate Tensile Strength, ksi | 0.2% Yield Strength, ksi | Minimum Bend Radius, 64ths Good Way | Bad Way |
|---|---|---|---|---|
| A | 121 | 113 | 3 | 16 |
| B | 123 | 114 | 3 | 8 |

EXAMPLE VI

This example demonstrates the effect of aging after cold rolling. Several samples of DC cast Alloy B from Example I were processed as in Example II to 0.080 inch gage and annealed at 675°C for 1 hour. The samples were processed to a final gage of 0.020 inch using the variations below.

Process A — cold roll directly to 0.020 inch gage

Process B — age at 400°C for 16 hours and cold roll to 0.020 inch gage

Process C — cold roll 25% to 0.060 inch gage, age at 400°C for 16 hours and cold roll to 0.020 inch gage Process D — cold roll 50% to 0.040 inch gage, age at 400°C for 16 hours and cold roll to 0.020 inch gage Process E — cold roll to 0.020 inch gage and age at 400°C for 16 hours The data shown in Table VI, below demonstrate that aging prior to cold rolling (Process B) or after cold rolling (Process E) leads to strength that is simply equivalent to that obtained with no aging (Process A). However, aging after some cold rolling (Processes C and D) results in improved strength.

TABLE VI

| Process | Ultimate Tensile Strength, ksi | 0.2% Yield Strength, ksi |
|---|---|---|
| A | 108 | 103 |
| B | 109 | 102 |
| C | 124 | 116 |
| D | 124 | 114 |
| E | 108 | 102 |

EXAMPLE VII

The following example illustrates the magnetic phase in the alloys of the present invention and the increased magnetic pull upon aging. Samples of Alloy B and Alloy 725 were DC cast as in Example I and hot rolled as in Example II. The samples were surface milled to produce a clean surface followed by cold rolling to 0.060 inch gage and annealing at 675°C for 1 hour. The samples were then aged at 450°C and the change in magnetic strength was measured as a function of aging time. In the Magnetic Force Measurement a sample 3 inches long by ¾ inch wide by 0.060 inch thick is suspended on one side of a microbalance, and the balance is tared. A magnet is then placed close to, and under the suspended sample (within ~1/16 inch). If the sample is magnetic, it will be attracted to the magnet and the balance beam will become unbalanced. The additional weight required to overcome the attractive force, i.e., break away from the magnet, is measured. By keeping constant the test magnet used, sample geometry, and the precise relative position between the sample and magnet, changes in the measured attrative force will be due only to changes in the concentration of magnetic phase present.

The measurement was made on a given sample prior to aging and at various intervals during aging. To measure the intervals, the aging treatment was interrupted, i.e., sample was cooled to room temperature, measurement was made, and sample was reheated to aging temperature and held at temperature until the next interruption. The results are shown in Table VII, below.

TABLE VII

| Alloy | Aging Time, Hours | Magnetic Attractive Force, Grams |
|---|---|---|
| B | 0 | 1.36 |
| B | 19 | 1.95 |
| B | 35 | 2.24 |
| B | 100 | 2.88 |
| 725 | 0 | nil |
| 725 | 19 | nil |
| 725 | 35 | nil |
| 725 | 100 | nil |

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for preparing wrought copper base alloys having good strength and bend characteristics, good solderability and low contact resistance which comprises:

A. providing a copper base alloy consisting essentially of from 7 to 14% nickel, from 1.5 to 3.3% tin with the minimum nickel plus tin content being 9.5%, a material selected from the group consisting of iron from 0.1 to 3%, cobalt from 0.1 to 3% and mixtures thereof wherein the minimum iron plus cobalt content in the alloy is 1.0%, balance copper;

B. hot rolling said alloy with a finishing temperature in excess of 550°C;

C. cold rolling said alloy with a cold reduction of at least 20%;

D. annealing said alloy at a temperature of from 300° to 850°C for at least 1 minute;

E. cold rolling the alloy with a reduction of at least 20%;

F. aging at a temperature of from 300° to 550°C for from 15 minutes to 24 hours; and G. cold rolling the alloy with a reduction of from 20 to 55%, thereby providing a wrought copper base alloy having a fine grain size below 0.025 mm and characterized by the presence of a fine, dispersed magnetic phase containing said material selected from the group consisting of iron, cobalt and mixtures thereof.

2. A process according to claim 1 wherein said copper base alloy contains both iron and cobalt.

3. A process according to claim 1 wherein said copper alloy has a nickel content from 9 to 11%, a tin content from 2 to 3% and a minimum nickel plus tin content of 11.5%.

4. A process according to claim 1 wherein said iron content is from 0.5 to 3%, said cobalt content is from 0.5 to 3% and the minimum iron plus cobalt content is 1.5%.

5. A process according to claim 1 wherein the alloys are cast at a temperature of at least 1150°C.

6. A process according to claim 5 wherein the alloys are melted at a temperature of at least 1250°C.

7. A process according to claim 1 wherein the alloy is hot rolled at a starting temperature from 850° to 975°C.

8. A process according to claim 1 wherein the alloy is cold rolled from 40 to 70% in step (C).

9. A process according to claim 1 wherein the alloy is cold rolled from 20 to 50% in step (E).

10. A process according to claim 1 wherein the microstructure of the resultant wrought copper base alloy includes a nickel-tin phase distributed throughout the matrix.

* * * * *